United States Patent [19]

Higuchi et al.

[11] 4,296,145

[45] Oct. 20, 1981

[54] METHOD FOR COATING ONE SIDE ONLY OF STEEL STRIP WITH MOLTEN COATING METAL

[75] Inventors: Seizun Higuchi, Kitakyushu; Kazuhiro Tano, Nakama; Minoru Kamada; Susumu Okamoto, both of Kitakyushu, all of Japan

[73] Assignee: Nippon Steel Corporation, Tokyo, Japan

[21] Appl. No.: 108,154

[22] Filed: Dec. 28, 1979

[30] Foreign Application Priority Data

Dec. 30, 1978 [JP] Japan ..... 53/165280

[51] Int. Cl.[3] ..... B05C 3/18; C23C 1/02

[52] U.S. Cl. ..... 427/47; 427/349; 427/398.4; 427/432; 427/433; 427/434.3; 118/63; 118/69; 118/410

[58] Field of Search ..... 427/434.3, 433, 432, 427/96, 300, 47, 398.4, 349; 118/410, 63, 411, 69; 228/37

[56] References Cited

U.S. PATENT DOCUMENTS

| | | | |
|---|---|---|---|
| 3,713,876 | 1/1973 | Lavric | 427/433 |
| 4,072,777 | 2/1978 | Schoenthaler | 427/433 |

FOREIGN PATENT DOCUMENTS

| | | | |
|---|---|---|---|
| 2656524 | 6/1978 | Fed. Rep. of Germany | 427/300 |
| 1399707 | 7/1975 | United Kingdom | 118/410 |

*Primary Examiner*—Ralph S. Kendall

*Attorney, Agent, or Firm*—Cushman, Darby & Cushman

[57] ABSTRACT

Passed through a chamber holding a non-oxidizing atmosphere substantially horizontally, a steel strip is continuously coated on one side only with a molten coating metal. An electromagnetic pump imparts a thrust to the molten coating metal on the entry side of a guide so as to form a stream of the molten metal rising above the bath surface on the exit side of the guide. The rising molten metal stream contacts the bottom surface of the strip to form a film of the coating metal thereon. Provision is made to offer less flow resistance to the rising stream widthwise then lengthwise, so that the molten coating metal flows positively toward both edges of the strip.

11 Claims, 27 Drawing Figures

METHOD FOR COATING ONE SIDE ONLY OF STEEL STRIP WITH MOLTEN COATING METAL

BACKGROUND OF THE INVENTION

This invention relates to a method and apparatus for continuously coating one side only of a steel strip, running lengthwise, with a molten coating metal.

The practice to protect a base steel from corrosion by applying such metallic coatings as zinc, aluminum, Zn-Al and Pb-Sn alloys, etc. is widely known.

There are several applications that require the protective coating on one side only of the base steel. For example, one-side galvanized sheets are finding increasing use as a corrosion-resistant material for automative parts.

To meet such a demand, many one-side molten metal coating methods have been proposed. One known method, for example, achieves one-side coating by dipping base steel in a molten coating metal bath after forming a film of a material such as water glass on that side of steel which is to be left uncoated. But the forming of such a coating-preventive film makes the entire coating process complex. The film has to be removed on completion of metallic coating. The quality of the stripped surface may no longer be the same as that of the original bare steel. For example, phosphatability and solderability may be impaired.

According to this invention, a molten metal coating is given on one side only of a base steel without requiring the application of any pretreatment on the other side. Several similar pretreatment-less one-side coating methods are known, too. According to one known method, base steel is brought over a molten metal bath, with the side to be coated facing the bath surface so as to come in contact with a coating roll partly immersed in the metal bath. Another method lifts the surface of the metal bath by rotating an immersed impeller herein. The steel surface to be coated is brought into contact with this lifted or impelled portion of the bath. Japanese Official Gazette No. 49-25096 and Patent Publication No. 53-75124 disclose such one-side coating methods that bring the molten metal into contact with the steel surface by mechanical means. Immersed in the molten metal bath at high temperature, however, the coating roll and impeller employed by such known methods require special protection. Besides they cannot withstand use over a long period of time. Therefore, these methods are difficult to put into practice.

Japanese Patent Publication No. 53-60331 discloses practically the same one-side coating method. A pneumatic device produces an updraft to raise the metal bath surface for contact with the steel surface to be coated. This method too involves practical difficulties, especially in producing an updraft that is even and continuous widthwise.

A soldering device according to British Pat. No. 1,399,707 uses an electromagnetic pump for the transfer of molten metal. The electromagnetic pump and an auxiliary pumps send forth molten metal through a rectangular passage, perpendicularly with respect to the metal bath surface. The resultant raised metal is supplied to or brought into contact with the bottom surface of base metal sheet. The molten metal is raised at the exit end of the rectangular passage enclosed by four guide plates, at entry and exit ends and on both sides, projecting above the metal bath surface. Excess metal returns on the bath from the entry and exit ends only, flowing over the guide plates on both sides.

In applying this method to the manufacture of one-side coated steel sheets, the raised metal must be uniformly supplied to or brought into contact with the steel surface to be coated, which can be attained by slightly pressing the steel sheet against the raised metal or supplying a slight excess of molten metal. Under such conditions, however, molten metal may be pressed against the side guide plates and sheet edges, so that there arises a high probability of molten metal flowing over to the surface that should not be coated.

As mentioned before, this method exerts a metal raising force perpendicular to the bath surface. When the balance between the rising force and the gravity-induced falling force of molten metal breaks, the raised metal tends to become wavy, preventing the uniform molten metal supply or contact.

This method controls the coating weight and widthwise coating distribution by no other means than the supply or contact of the raised molten metal. This calls for maintaining the line speed of the base steel as well as the quantity of molten metal for supply or contact at constant levels, which in turn require operating conditions as are too severe to be practical. In addition, the flowing of molten metal in the atmosphere greatly accelerates its oxidation. All these disadvantages make this method impracticable.

A method of one-side coating utilizing an electromagnetic pump for the transfer of molten metal is disclosed in Japanese Patent Publication No. 53-138930, based on an application filed by the inventors, and elsewhere. A steel strip whose surface has been pretreated ready for molten metal coating is introduced over a bath of molten coating metal kept in a non-oxidizing atmosphere. Coating metal is moved by electromagnetic induction so that part of the flowing metal rises to contact the bottom surface only of the steel strip. Subsequent wiper rolls or gas wiping controls the coating weight and smooths the coated surface.

All these publications have failed to provide any definite method or apparatus that insures stable production of one-side coated steels on a commercial scale. They lack considerations to the following important requistes to the stable commercial production of one-side coated steels;

(1) Effective application of an electromagnetic pump to the transfer of molten coating metal;

(2) Coating of one side only of steel strips of varying widths, leaving the opposite side uncoated, with molten coating metal, uniformly across the strip width including both edges;

(3) Protection of the non-coated surface from the contaminating by splashes and fumes of molten metal;

(4) Control of the coating weight and smoothening of the coated surface to the desired levels; and (5) Provision of good surface quality and phosphatability to the non-coated side.

SUMMARY OF THE INVENTION

This invention is intended for solving the above problems with the conventional method and apparatus for coating one-side only of steel strip with a molten coating metal.

An object of this invention is to provide a one-side metal coating method and apparatus that forms an even film of coating metal on one side only of said metal strip, and preventing the molten coating metal from flowing over to the opposite side.

Another object of this invention is to provide a one-side metal coating method and apparatus that produces a one-side coated strip having excellent appearance with no defects on both coated and non-coated sides.

Yet another object of this invention is to provide a one-side metal coating method and apparatus that produces a one-side coated strip with a non-coated side having an excellent phosphatability.

Still another object of this invention is to provide a one-side metal coating method and apparatus that performs the one-side coating operation easily and reproducibly.

In order to achieve these objects, the method and apparatus for coating one side only of a steel strip with a molten coating metal according to this invention passes the steels strips substantially horizontally through a chamber holding a non-oxidizing atmosphere. An electromagnetic pump imparts a thrust to the molten coating metal on the entry side of a guide so as to form a stream of the metal rising above the bath surface on the exit side of the guide. The rising molten metal stream is brought in contact with the bottom surface of the strip to continuously form a film of the coating metal thereon. Here, characteristic provision is made to offer less flow resistance to the rising stream widthwise than lengthwise with respect to the running strip. Accordingly, the molten coating metal flows to both edges of the strip, then down on to the metal bath. This insures adequate supply of the coating metal to both strip edges, with ensuing uniform coating, not only lengthwise but also widthwise. In addition, the coating metal is prevented from flowing over to the opposite side of the strip which has to be left uncoated.

BRIEF DESCRIPTION OF THE DRAWINGS

FIGS. 3 through 13 are perspective views showing various embodiments of a molten coating metal overflow box attached to a molten coating metal guide used in the oneside coating apparatus of this invention. FIG. 3 shows an overflow box whose opening is defined by straight lines. FIG. 4 shows an overflow box whose opening is defined by curved lines. FIG. 5 shows an overflow box whose opening is defined by a combination of a curve and straight lines. FIG. 6 shows an overflow box similar to the one in FIG. 3, except that the opening has a smaller width than the strip. FIG. 7 is similar to FIG. 4, except that the opening width is small than the strip width. FIG. 8 shows an overflow box having an opening enclosed with a barrier. FIG. 9 shows an overflow box having an opening whose width is adjustable. FIG. 10 is similar to FIG. 8, except that the opening is provided with width-adjusting shielding plates. FIG. 11 shows an overflow box provided with a flared skirt. FIG. 12 shows an overflow box provided with a hood. FIG. 13 shows an overflow box provided with covers.

DETAILED DESCRIPTION OF THE PREFERRED EMBODIMENT

A steel strip that is to be coated on one side only with a molten coating metal according to the method of this invention must be treated first to make its surface ready for such coating, as with conventional metal coating methods.

For example, oils and other organic surface contaminants must be removed by electrolytic defatting, oxidizing burning and other methods. These cleaning methods need not be of any special kind, but may suitably be selected so far as they can achieve the object of this invention.

The cleaned strip surface is then activated to facilitate subsequent coating. At least that side of the strip to be coated is activated in a reducing-annealing furnace. Thence, the activated strip is fed into a sealed one-side coating zone in which the space above a coating metal bath, through which the strip passes, is filled with a non-oxidizing atmosphere.

Suitably tensioned, the strip substantially horizontally passes through the sealed non-oxidizing atmosphere over the molten metal bath. An electromagnetic pump and a guide installed opposite to the bottom surface of the strip bring the raised flow of molten metal into contact therewith. Excess coating metal is wiped off by a stream of gas to obtain the desired coating weight.

Before the coating metal solidifies, the coated strip is cooled in an atmosphere containing oxygen.

By removing an oxide film from the non-coated side in a pickling tank, a steel strip with one metal-coated surface and one clean bare surface is obtained. When necessary, the cleaned non-coated surface is subjected to a surface treatment for improved bonderizability in a surface treatment unit on the delivery side of the pickling tank.

Figure 1:
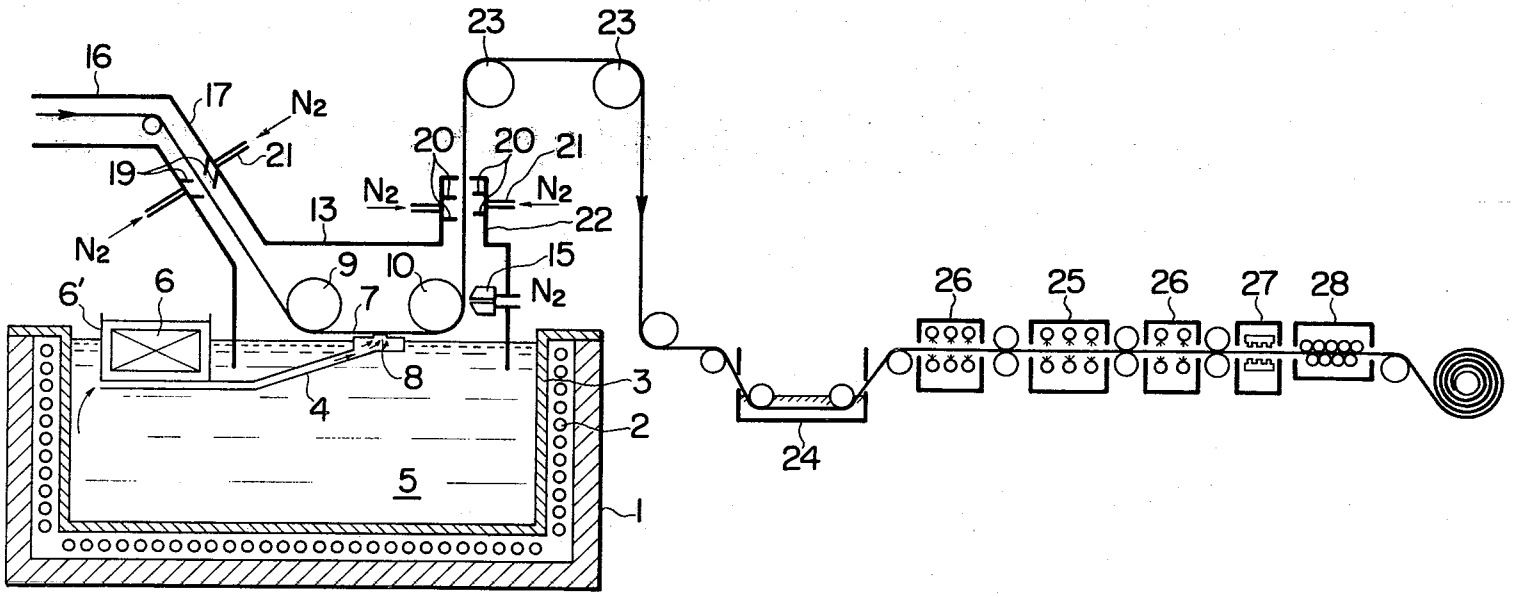
FIG. 1 is a schematic overall view of a one-side coating apparatus according to this invention.
Figure 2:
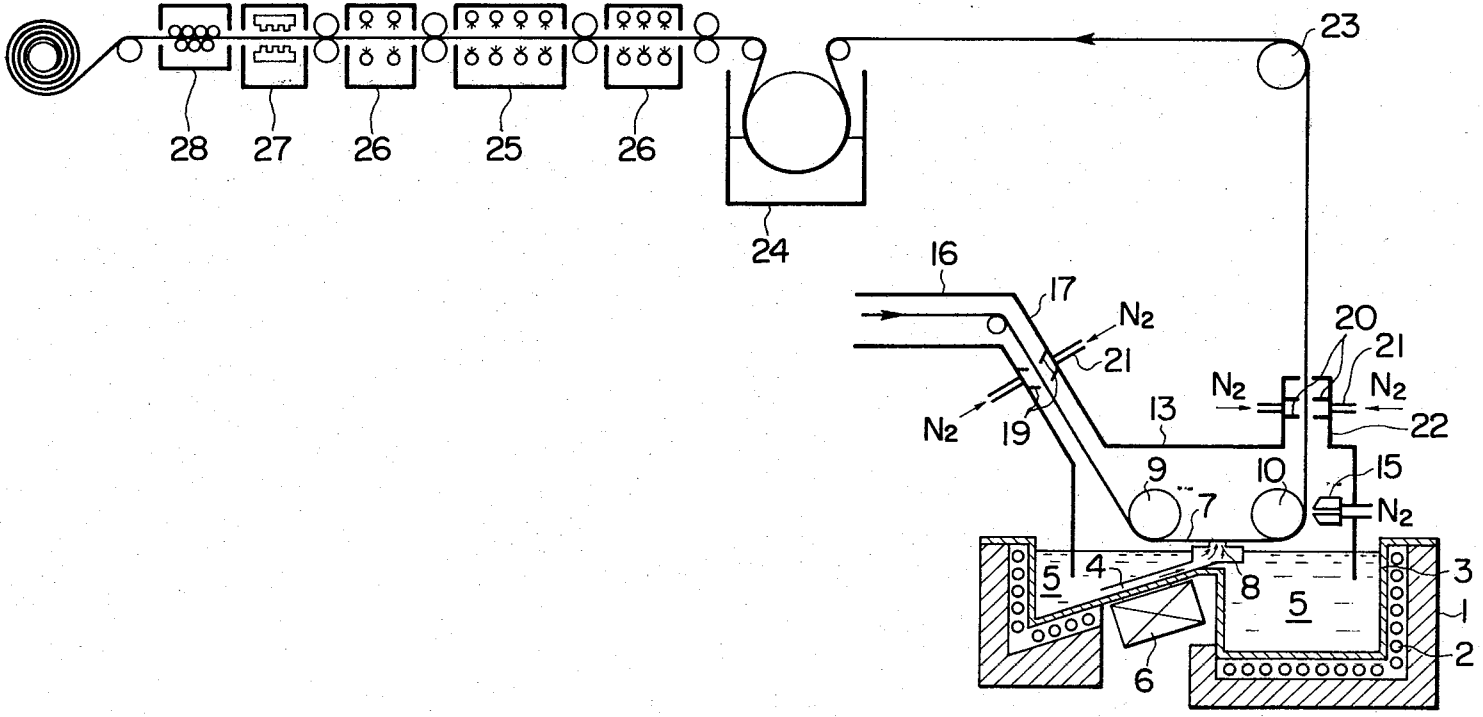
FIG. 2 is a schematic overall view of another embodiment of this invention.

FIGS. 1 and 2 show two embodiments of apparatus for implementing the one-side metallic coating according to this invention. Since the two embodiments are substantially the same in their principal part, similar reference numerals designate similar members or devices in the two figures. In FIG. 1, reference numeral 1 designates a coating metal melting unit incorporating a heat source 2. Item 3 is a melting pot. Reference numeral 4 denotes a guide immersed in a molten metal 5 contained in the melting pot 3 for producing a rising molten stream 8 in the molten metal 5 in conjunction with the action of an electromagnetic pump 6 installed in a container 6'. Item 7 is a steel strip that contacts the rising metal stream 8, passing over the surface of the molten metal bath. Items 9 and 10 are guide rolls for feeding the pretreated strip 7 onto the metal bath and sending it from a coating zone to a cooling zone, respectively. Item 13 is an atmosphere protection box to enclose the passage of the steel strip 7 over the coating metal bath 5, with the lower portion thereof being either immersed in the metal bath 5 or tightly secured to the side walls of the melting pot 3 to keep a non-oxidizing atmosphere inside. Reference numeral 15 designates a gas wiping nozzle that injects such high-pressure gas as $N_2$ against the coated surface of the strip to control the weight of the coating metal. Item 16 is a reducing annealing furnace. Item 17 is a snout. Reference numeral 19 denotes a gas seal mechanism that prevents the mixing of the gases in the reducing-annealing furnace 16 and atmosphere protection box 13 to the greatest possible extent. Item 20 is a gas seal mechanism to prevent the inflow of ambient air into part of the atmosphere protection box 13 and snout 17, the cooling zone and the strip exit section. Item 21 is an inlet for an atmosphere gas, and 22 is a cooling zone. Reference numeral 23 designate deflector rolls for guiding the one-side coated strip from the cooling zone to the subsequent processes including the cleaning of the non-coated surface. Item 24 is a pickling tank to remove an oxide film formed on the non-coated surface in the cooling zone. Item 25 is a surface treatment unit that provides a surface treatment to the cleaned non-coated surface for improving phosphatability. Reference numeral 26 designates a wash tank following the pickling and/or surface-treating process 27 a drying unit, and 28 a skinpass mill.

The one-side metal coating method and apparatus according to this invention imparts a shifting magnetic field to the molten coating metal 5 to develop a self-propelling force therein, actuating the electromagnetic pump 6. Thereupon, the molten metal moved through the guide 4 to create a rising stream. This guide 4 is made of such material as stainless steel, titanium, zirconium, tantalum and ceramic that are nonmagnetic and relatively immune to the corroding attack by the molten coating metal. Sometimes, the first mentioned metals are coated with ceramic or lined with refractory bricks. The gude 4 has a part extending parallel to the core surface of the electromagnetic pump 6, an inlet for the molten metal at the lower end thereof, and an outlet for the rising stream, opening directly below the strip 7 running thereover.

If the inlet of the guide 4 is located between 50 mm below the path surface and 50 mm above the pot bottom, oxide or dross of molten metal does not flow into the guide 4. The rising stream outlet must preferably be positioned at least 10 mm above the path surface. Otherwise, the coating metal may stain the non-coating side of the strip if the bath level changes during operation. The upper limit of the outlet height above the bath surface is not specified. But approximately 100 mm is a practical level, considering the capacity of the electromagnetic pump available today. The guide 4 consists of a passage having a rectangular cross-section whose width is $\frac{1}{4}$ to 1.25 times the strip width, preferably between $\frac{1}{2}$ and the strip width, and height ranges between 30 mm and 150 mm. The cross-section may be a square or circle of approximately the same area.

The shorter the distance between the electromagnetic pump and the molten metal, the higher the efficiency with which thrust is given to the molten metal in the guide. Therefore, rectangular cross-section, which keeps the core surface of the electromagnetic pump and the molten metal in the guide closer than other shapes, is preferable.

The electromagnetic pump to move the molten metal and the guide to bring the rising metal stream into contact with the bottom surface only of the running strip constitute two key factors of this invention.

Unlike other metal pumps, the electromagnetic pump can impart thrust to the molten metal without coming in direct contact.

Freed from direct exposure to high-temperature molten metal and dispensing with sliding members, the electromagnetic pump insures more stable metal supply, longer service life, and easier maintenance.

Another advantage of the electromagnetic pump is its ability to pump up from midway the molten metal bath, which prevents the adhesion of top or bottom dross on the coated strip surface.

As is well known, however, the thrust-given efficiency fo the electromagnetic pump is very low. The efficiency with currently available electromagnetic pumps is rated at not higher than approximately 1 percent of the electric energy loaded. The figure turns out not highwer than 0.5 percent in many cases.

Most of the loaded electric energy is consumed for heating copper coils (causing copper loss) and an iron core (causing iron loss) of an electromagnetic pump, and that part of a guide which stands opposite to the surface of the core (including the opposing surface of a pump container depending on how the pump is installed).

The most important problem with this invention is that the last mentioned heating of the opposing guide surface accounts for a consideration percentage of the non-thrusting energy consumption.

This invention needs no specification as to the copper and iron losses concerning the electromagnetic pump proper. Such losses can be reduced by using an efficiently designed electromagnetic pump. The resulting heating also can be coped with by air- or water-cooling.

Meanwhile, the heating of the guide must be prevented by minimizing an eddy current loss caused by the guide.

The eddy current loss due to the guide depends on the frequency applied to the electromagnetic pump, thickness and specific resistance of the guide material. The use of highly resistive, thin material and application of low frequency are effective for reducing the eddy current loss and, therefore, preventing the heating of the guide.

But it should be remembered that one side of the guide material is exposed to the flowing molten metal. Therefore, the thickness and properties, including specific resistance, of the guide material cannot be varied greatly, considering the corroding attack of the molten metal as well as the service life and strength of the guide itself. Therefore, this invention does not specify the thickness and properties of the guide material, through due consideration is given thereto.

By contrast, frequency can be varied greatly, and therefore its control proves effective for reducing the heating of the guide.

Accordingly, studies were made on the effect of the electromagnetic pump frequency on the eddy current loss and heating of the guide.

No general formula has been established as to the relationship between the frequency applied to the electromagnetic pump, which imparts thrust to the molten metal, and the eddy current loss and heating (amount of work done) of that part of the guide which stands opposite to the core surface of the electromagnetic pump.

But it is well-known that the amount of work done, or heating guide, on the guide surface facing the core surface of the electromagnetic pump is expressed as the product of the work done for imparting thrust to the molten metal multiplied by the travelling speed of magnetic flux. Since the multiplicand and multiplier are the functions proportional to frequency, the amount of work done for heating the guide is expressed as a function proportional to the square of frequency. If thrust is fixed constant, the product becomes a function proportional to frequency.

Studies were made as to the conditions that permit uniformly bringing the rising stream of molten metal through the guide to the bottom surface of the steel strip travelling at a height of approximately 10 mm to 100 mm above the bath surface and minimizing the heating of the guide surface facing the electromagnetic pump core, taking into account the frequency applied to the electromagnetic pump.

The studies proved the previously mentioned relationship that lower frequency, between 1 and 20 Hz, or preferably between 1 and 10 Hz, produces a better result.

A frequency below 1 Hz proved more effective in reducing the heating of the guide, but created pulsation in the rising stream of molten metal in the guide. This made it difficult to bring the rising metal stream into uniform contact with the bottom surface of the strip, entailing uncoated or unevenly coated strips.

A frequency above 20 Hz heats the guide extremely. Depending on the quantity of the flowing molten metal, the excessively heated guide may produce a localized hotter part in the molten metal, which results in the formation of thicker alloy layer on the strip.

The decreased skin effect of low frequency permits uniform travel of the molten metal through the guide and, therefore, uniform supply of the molten metal to the bottom surface of the strip, irrespective of the distance from the core surface of the electromagnetic pump or the position in the guide.

The rising stream outlet or overflow port must be such that a stream of molten metal raised by the electromagnetic pump and guide contacts the bottom surface (to be coated) only of the steel strip uniformly, without flowing over to the opposite side.

When a rising stream of molten metal is produced by electromagnetic induction, a guide, having an inlet for the molten metal and an outlet for the rising metal stream below and above the metal bath surface, respectively, must be provided to bring the rising metal stream into contact with the desired position of one side of the running steel strip.

In the conventional guide, the rising metal stream, thrusted from the inlet, has been supplied through the outlet perpendicularly. Therefore, when the balance between the upward thrust applied to the molten metal and the gravity working on such coating metal as Zn, Zn-Al and Pb-Sn alloys having a relatively large specific gravity breaks, a wave resembling the pulsation with the ordinary pumps occurs in the rising molten metal stream. When this wave occurs, the rising metal stream, if not pushed up to an adequate height, fails to contact the coating surface of the strip, leaving some portion thereof uncoated. If the rising height is excessive, conversely, part of the metal stream may flow over to the opposite side of the strip which must be left bare.

A barrier is sometimes provided at the outlet to prevent the outflow of the rising metal stream in the direction of the strip width. Then, on contacting the strip surface, that portion of the rising stream forced out from both strip edges flow over to the non-coating surface, pushed into between the strip edge and intercepting barrier.

This invention provides a new outlet for the rising metal stream from the guide that has obviated such difficulties.

According to this invention, the rising metal stream formed at the outlet of the guide meets a smaller flow resistance widthwise than lengthwise, so that the molten metal is positively forced out to both edges of a substantially flat strip. This adjusting of flow resistance is accomplished by letting flow the rising stream of molten metal through a passage whose depth widthwise is equal to or greater than lengthwise.

Figure 3:
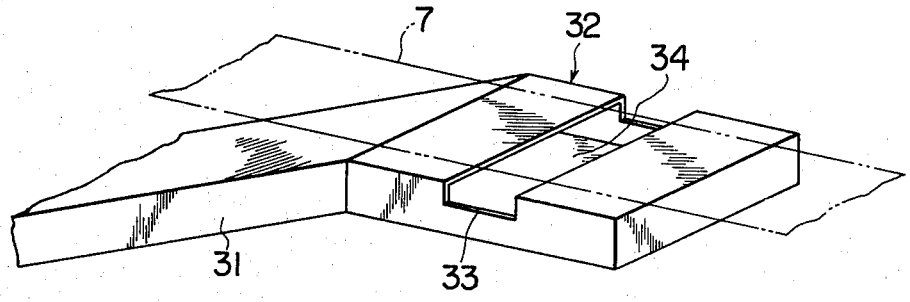

An outlet for the rising metal stream shown in FIG. 3 comprises an overflow box 32, having a rectangular cross-section, attached to the upper end of the guide 31. A middle part of the top surface is cut open to provide a metal overflow port 34, with both sides thereof being cut deeper. The overflow box 32 is opened at one end to communicate with the guide 31 and closed at the other.

Figure 4:
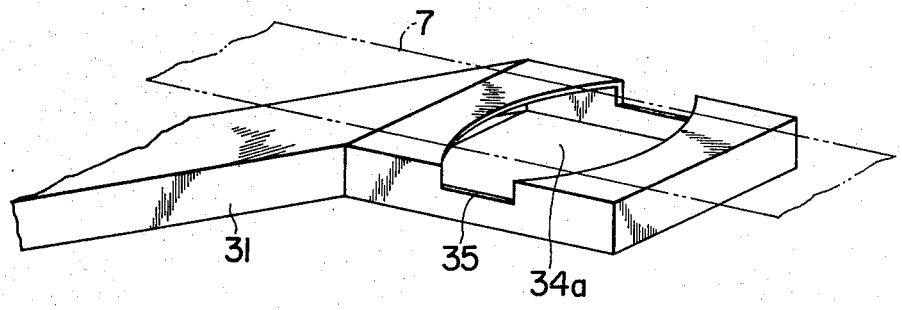
Figure 5:
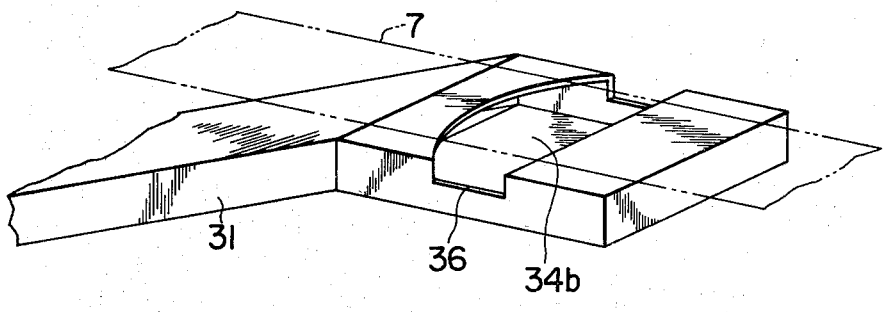

FIGS. 4 and 5 show modifications **34*a* and 34*b* of the rectangular overflow port in FIG. 3, the long sides of which comprises two symmetrical curves, and one straight line and one curved line, respectively. Both outlets each have similar deeper side cuts 35 and 36**.

On contacting the bottom surface of the strip, the rising metal stream evenly expands widthwise, then flows downward through the side cuts, without flowing over to the opposite or top surface to be left uncoated.

Experimentally, side cuts deeper than 2 mm have proved useful to insure smooth widthwise overflow of the molten metal.

Figure 6:
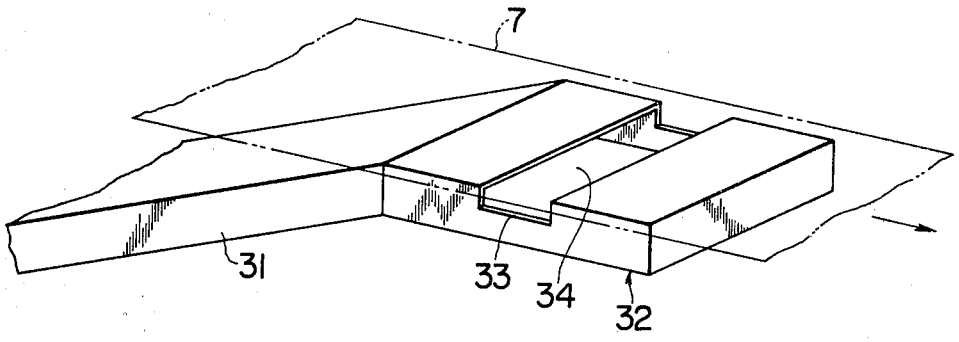
Figure 7:
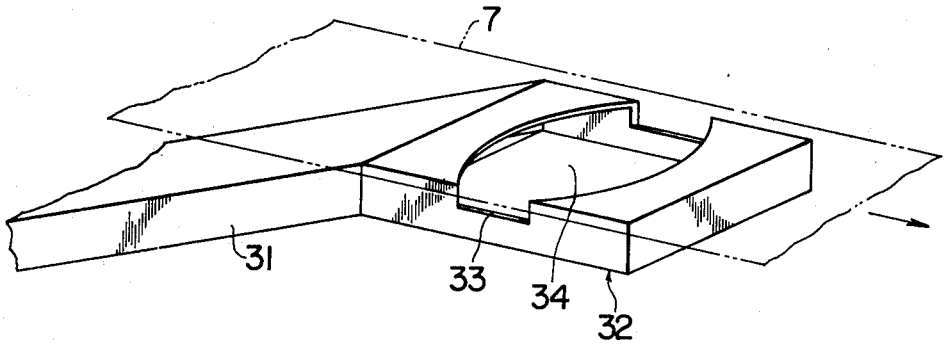

Preferably, the width of the overflow ports 34, **34*a* and 34*b* should be kept smaller than the width of the steel strip 7 that runs thereover, as shown in FIGS. 6 and 7**.

At the moment of initial contact, the rising metal stream running out of such an overflow port has a narrower width than the strip. This eliminates the need of strict control on the thrust imparted to the molten metal. Because of this overflow port design, even a considerably strongly thrusted metal stream, on contacting the steel strip, spreads evenly along the bottom surface thereof, then flows downward without staining the opposite surface.

The width of the overflow port 34, **34*a* or 34*b* may be smaller than that of the strip 7** from by 10 mm on each side down to approximately one-forth, or preferably one-half, thereof.

Figure 8:
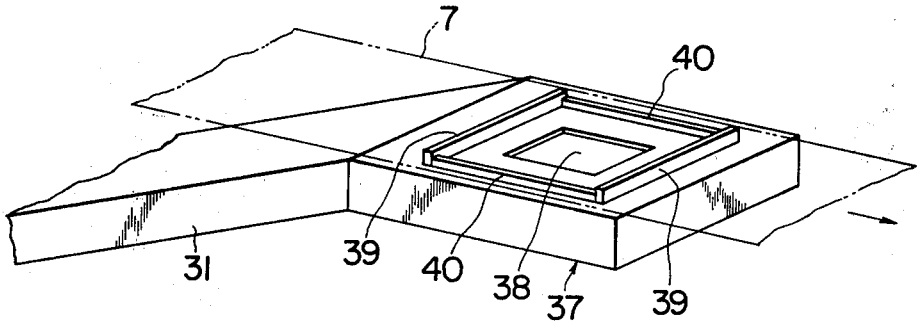

FIG. 8 shows another horizontal overflow box 37 attached to the end of the guide 31. An overflow port 38 is opened in the top surface thereof, leaving margins on all four sides. The overflow port 38 is enclosed by a front and rear barriers 39 and overflow barriers 40 on both sides. The width of the overflow port 38 is smaller than that of the strip. The side barriers 40 are lower than the front and rear barriers 39. These side barriers 40 are optional.

This combination also produces the same effect as described previously. The shape of the overflow port need not always be rectangular as illustrated, but may consist of curved lines.

Figure 9:
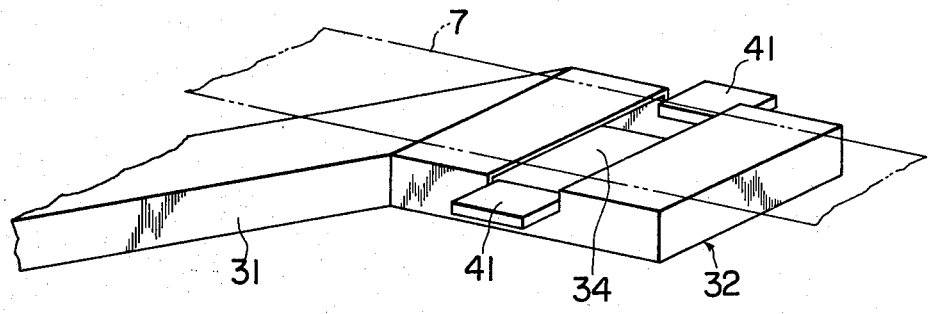

Since strips of varying widths are passed, the width of the overflow port, which should always be smaller than the strip width, should preferably be adjustable in accordance with a change in the strip width. For example, FIG. 9 shows slidable cover plates 41 to adjust the width of the overflow port 34, positioned below the top level thereof. The optimum width can be always secured by sliding the cover plates 41 widthwise according to the width of the strip being passed.

Figure 10:
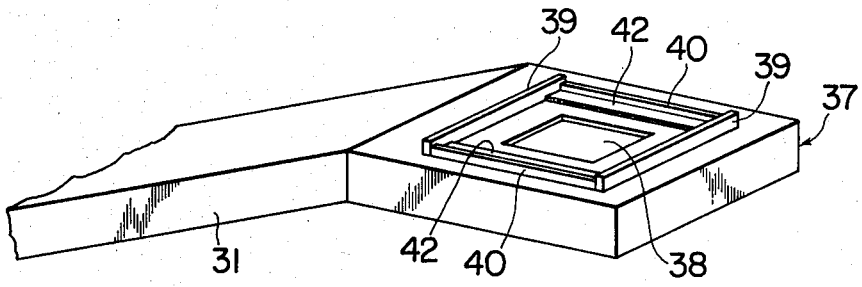

FIG. 10 shows an example of width adjustment for the overflow port 38 shown in FIG. 8. The port width is adjusted by moving cover plates 42 together with the side barriers 40 attached thereto.

Figure 11:
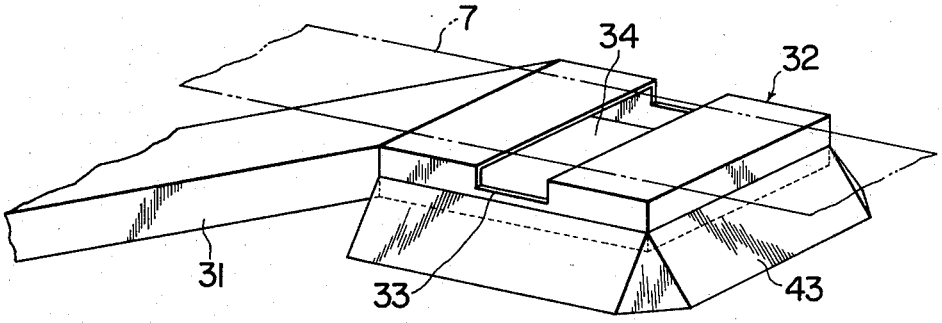

The rising metal stream flowing out mainly widthwise from the overflow port falls back onto the molten metal bath. During this fall, the molten metal sometimes splashes onto the non-coated surface of the strip. This splash can be prevented by providing flared plates 43 below the overflow port as shown in FIG. 11, an inversed-channel-shaped hood 44 over the overflow box as shown in FIG. 12, or an arched cover 45 on each side of the overflow port as shown in FIG. 13.

Such protective hood etc. protect the non-coated strip surface from being stained by dust on the like, formed by the evaporated molten metal, falling from the atmosphere protection box etc.

The length of the overflow port in the travelling direction of the strip depends on the contact time required by the molten metal to react with the strip to form a layer of alloy on the surface thereof. This contact time varies with the temperature and surface condition of the strip, line speed, kind of the coating metal, etc. For example, zinc and aluminum coating each requires the contact time of not less than 0.05 second. From this, the length of the overflow port should be 30 mm or greater, or more preferably between approximately 100 mm and 500 mm, for the line speed of the currently available molten metal coating equipment.

The steel strip must be passed substantially horizontally under the tension exerted by the two guide rolls. The reasons for this are as follows:

(1) If the passed strip is arched up with respect to the metal bath surface, it becomes difficult to supply the molten coating metal across the entire width of the strip, leaving some portion thereof uncoated. Excess supply of the molten metal, on the other hand, causes the frequent occurrence of splashing due to the falling of the metal from the strip edges onto the molten metal bath. Once the molten metal flows over to the opposite side of such a concave strip, in addition, the entire surface thereof may be covered by the metal.

Besides, the curved strip is difficult to press flat against the guide roll 10, which makes the wipe-off of the excess coating metal impracticable. This entails uneven distribution of the coating metal across the strip width, and increases the probability of the excess metal flowing over to the opposite side.

(2) It is very difficult to pass a strip in an arched-down manner with respect to the molten metal bath surface. Even if accomplished, even molten metal supply and even coating weight distribution through wiping can hardly be achieved, as with the concave strip.

(3) Accordingly, the strip must be kept substantially flat and horizontal.

In FIG. 1, the electromagnetic pump 6 is placed in the container 6', which is partly sunk in the molten metal bath so that the bottom thereof contacts the immersed guide 4. As shown in FIG. 2, the pump 6 may be attached aslant to the melting pot bottom from below. Or the entirety of the pump 6, held in the container 6', may be immersed in the metal bath, as shown in FIG. 14.

As mentioned before, a considerable portion of the loaded electrical energy is consumed for heating the copper coils and iron core in the electromagnetic pump. To insure efficient impartment of thrust to the molten metal, therefore, the pump must be positioned as close to the molten metal as possible. Under the influence of the hot metal bath and melting pot heat source, added to the effect of copper and iron losses, the temperature inside the electromagnetic pump becomes considerably high.

Unless air- or water-cooled to approximately 100° C., preferably to below 80° C., therefore, the copper coils of the pump may become deinsulated with ensuing pump malfunction.

Figure 14:
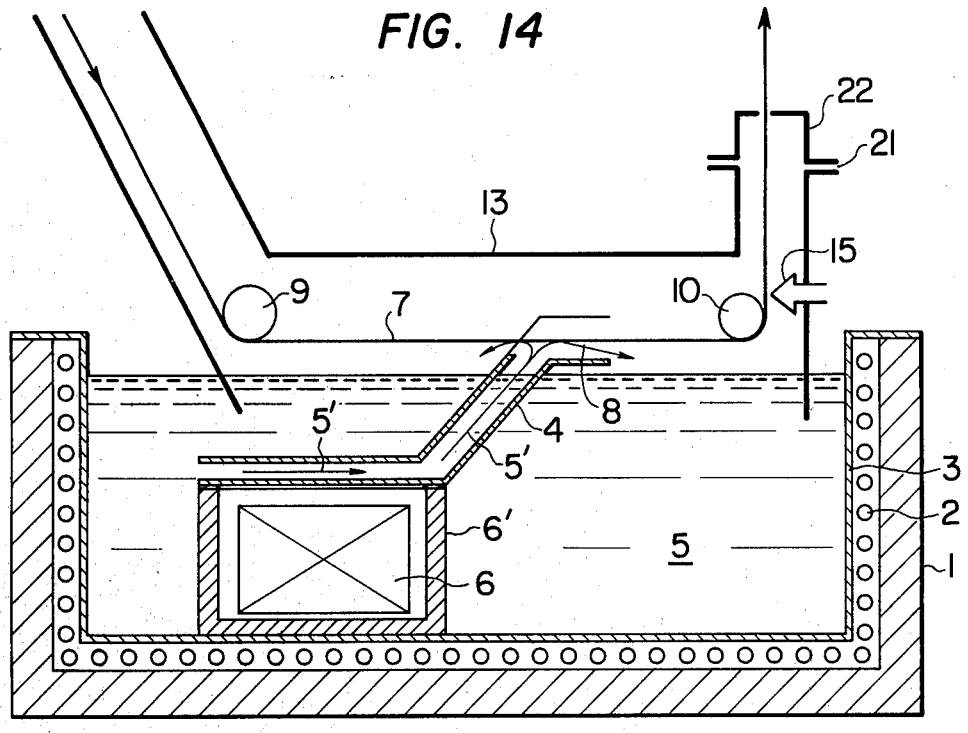
FIG. 14 schematically shows an arrangement of an electromagnetic pump in a coating metal melting pot.

The electromagnetic pump fully immersed in the metal bath or attached to melting pot bottom, as shown in FIGS. 14 and 2, is difficult to cool. With the pump 6 of FIG. 14, a cooling medium feeder pipe must be passed thorugh the molten metal bath 5, which naturally heats the cooling medium during transfer. To overcome this difficulty, a large quantity of, or an extremely low-temperature, cooling agent must be supplied. But this solution too involves several industrial and economic disadvantages, such as the cooling of molten metal.

Positioned near the heat source, the electromagnetic pump 6 of FIG. 2 too needs plenty of, or cryogenic, coolant.

When the guide 4 or container 6' breaks, the electromagnetic pump 6 in FIG. 14 can hardly be taken out of the metal bath undamaged.

If the pot bottom in FIG. 2, serving for the guide too, breaks, the molten metal 5 flows outside and the outside air enters the sealed structure, reducing furnace, etc. to creat the risk of explosion.

For these reasons, the arrangement of FIG. 1 is preferred, in which the container 6', holding the electromagnetic pump 6 inside, is partly immersed in the molten metal bath 5, with the guide 4 connected to the container bottom.

Figure 15:
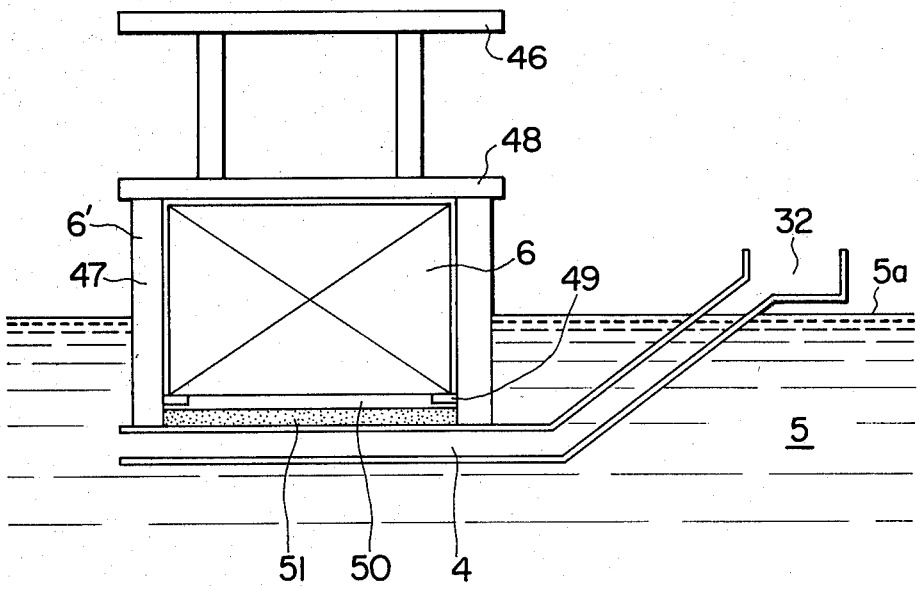
FIG. 15 is a schematic view showing a preferred arrangement of the electromagnetic pump.
Figure 16:
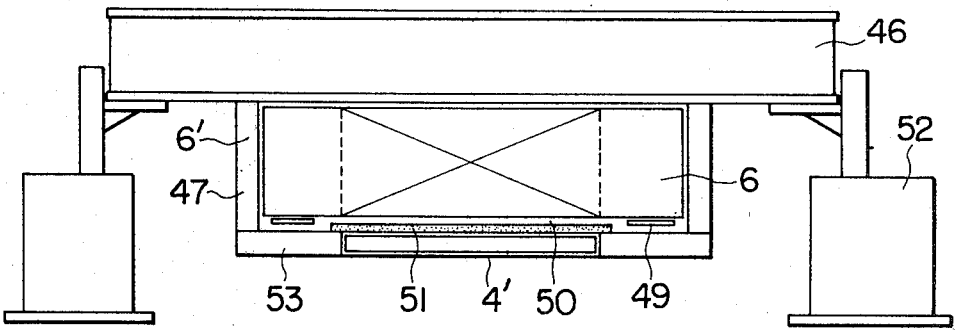
FIG. 16 is a front view similar to FIG. 15.

A cross-sectional view in FIG. 15 and a front view in FIG. 16 illustrate the arrangement of FIG. 1 in greater detail. The container 6', holding the electromagnetic pump 6 inside, is suspended by a container support 46 so that part thereof sink in the molten metal bath 5.

Sustained by support projections 49 inside the container 6', the bottom of the electromagnetic pump 6 faces at heat insulator 51 and the guide 4 with a space 50 therebetween.

The electromagnetic pump 6 thus disposed can be cooled more easily, by providing a coolant passage in a container top 48 and taking advantage of the space 50 below the container bottom.

The heat insulator 51 and container side walls 47 considerably prevent the pump 6 from being heated by the metal bath.

Provision of a mechanism to adjust the level of the container support 46 permits controlling the immersion depth of the container 6', in the metal bath at will.

The most desirable position is that the container bottom 53 or guide top 4', lies at a small depth below the bath surface.

Even if the guide top 4' and container bottom 53 break to introduce the molten metal into the container, the metal level inside the pot drops only a little, preventing the inflow of outside air into the coating system.

In addition, easy accessibility from outside facilitates inspection and repair of the electromagnetic pump.

Using this method and apparatus, the steel strip is coated with molten coating metal on one side (bottom side in the figure) only, leaving the opposite side uncoated. Where the coated strip contacts the guide roll 10, which introduces the strip from the coating zone to the cooling zone in FIG. 1 or 2, the gas wiping nozzle 15 injects $N_2$ or other similar gas at cold or high temperature under pressure to wipe off excess coating metal, thereby controlling the weight and widthwise distribution of the coating metal.

This coating weight and distribution control is accomplished by the wiping nozzle 15 facing the guide roll 10 where the strip, which has thus far travelled substantially horizontally, is turned up substantially vertically by the guide roll 10.

Application of gas wiping at the point where the strip 7 is in contact with the guide roll 10 prevents the wipe-off excess metal from flowing over the opposite side, because said opposite side is pressed tight against the guide roll 10 by tension and the high-pressure injected gas. Preferably, the guide roll 10 should have a diameter not smaller than 200 mm. With a large-diameter guide roll 10, the gas wiping nozzle 15 is positioned far away enough to keep the metal bath freed of the jetting effect and resulting splashing. The coating weight and distribution control is performed by adjusting the flow rate (or pressure) and temperature of the high-pressure gas (usually $N_2$ gas) and the clearance between the strip 7 and wiping nozzle 15.

According to this invention, the $N_2$ gas supply pipe, leading from the gas source to the wiping nozzle 15, is passed through the reducing-annealing furnace 16 or coating metal bath 5 so that the $N_2$ gas is heated therein. This method offers a great advantage in heat economy, compared with the use of an independent heat source.

Figure 17:
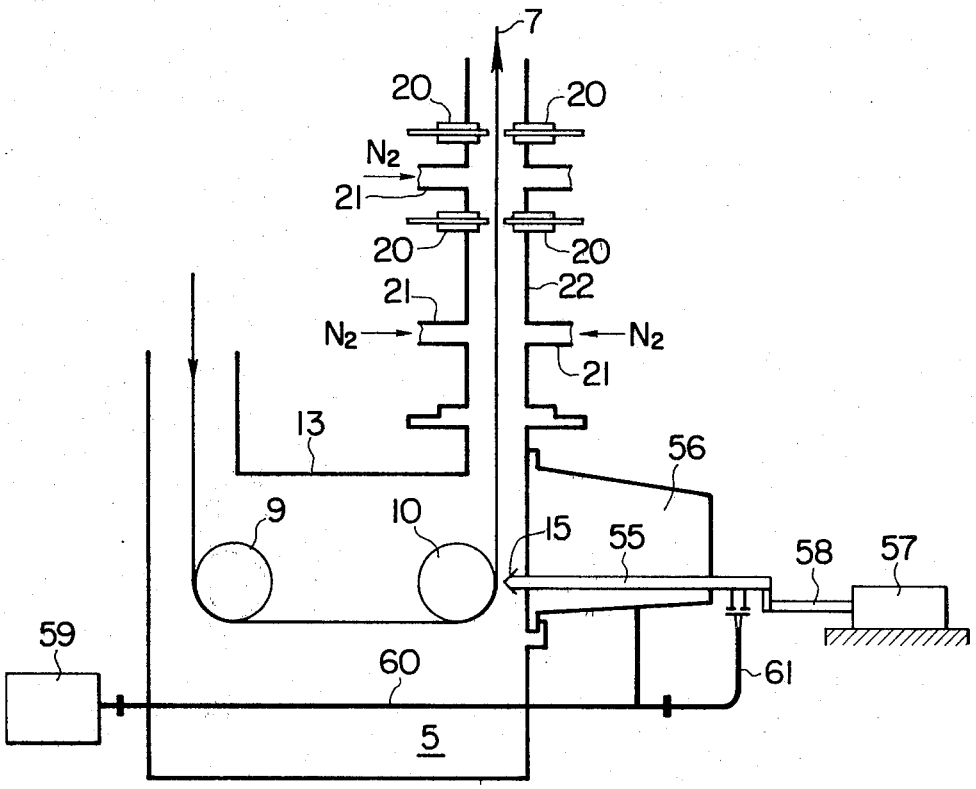
FIG. 17 illustrates a gas wiper, gas seal mechanism and seal gas inlets in the coating apparatus.

FIG. 17 shows an example of the wiping nozzle unit. The nozzle 15 is connected to the foremost end of a gas supply pipe 55 which is movably held in a seal box 56, with the rearward end thereof connected to a rod 58 of a hydraulic cylinder 57. A heat-resistant pipe 60 extends from a wiping gas source 59 through a coating metal melting unit 1, so that the wiping gas is heated midway by the heat of the molten metal 5. The foremost end of the heat-resistant pipe 60 is branched to connect with the seal box 56, and with the rearward portion of the gas supply pipe 55 by way of a flexible tube 61.

To control the coating metal weight on the strip 7, the space between the wiping nozzle 15 and strip 7 is adjusted by operating the hydraulic cylinder 57.

Material quality of the guide roll 10 is important. The excess coating metal wiped-off from the strip 7 or the splash thereof sticks to the guide roll 10. Besides, this guide roll 10 is always exposed to the vapor evaporating from the molten metal bath in the sealed structure containing a non-oxidizing atmosphere. Therefore, adhesion and precipitation of the evaporated molten metal on the guide roll 10 are indispensable. The guide roll 9 too is subjected to the same adhesion and precipitation. When these guide rolls are thus stained, the molten metal on them may adhere to or damage the non-coated surface of the strip.

For this reason, the guide rolls must be made of such material as is hardly liable to reaction with the molten coating metal, and permits removing adhered or precipitated coating metal with ease. Namely, the entire of the guide rolls or at least the surface thereof must consists of an unwettable material that does not form an alloy layer thereon reacting with the molten coating metal. In addition, the surface of the guide rolls must be smoothened as much as possible.

Rolls made of tantalum or high-chromium steel are desirable for such coating metals as zinc, Zn-Al alloy and aluminum. But rolls prepared by the following method are more economical and practical.

A roll is made of steel or stainless steel, and a suitable material unwettable to molten zinc, Zn-Al alloy and aluminum is sprayed over the surface thereof to form a layer of $50\mu$ to $2000\mu$ in thickness. The unwettable spraying material may be selected from among chromium oxide, alumina, titanium oxide, zirconium oxide, magnesium and calcium zirconate, tantalum, tungsten carbide, titanium carbide, and so on.

The layer thickness is limited between $50\mu$ and $2000\mu$ for the following reason: A layer not heavier than $50\mu$ does not produce the desired effect, while one $2000\mu$ thick or heavier is uneconomical, the effect becoming saturated, and grows less adhesive to the roll body. The molten unwettable material is sprayed at high speed and pressure, using a plasma jet, to form a highly dense and adhesive coating over the pre-cleaned roll surface.

Further, it is preferable to specify the surface roughness of the coated roll surface thus obtained to be not higher than 2.5 $\mu$Ra. If the surface roughness exceeds 2.5 $\mu$Ra, effective surface area of the coated roll surface increases. This increases the bondability of molten zinc or other coating metal and those evaporated or precipitated from the metal bath, due to the anchoring effect thereof, and causes increased adhesion of the coating metal. Besides, the coating metal adhered to such rough-surfaced rolls is difficult to remove. Limiting the surface roughness to 2.5 $\mu$Ra and under decreases the adhesion of the coating metal and facilitates the removal of the adhered metal. This surface roughness of 2.5 $\mu$Ra is equivalent to 100 microinches AA according to the ASA standard. Normally having a roughness of between 6.25 $\mu$Ra and 12.5 $\mu$Ra, the surface of the as-sprayed coating layer must be polished or otherwise processed down to the specified roughness level.

The guide rolls are thus surfaced with such material as is unwettable to and does not react with molten zinc, Zn-Al alloy and aluminum, with the coated layer surface being suitably smoothened. Therefore, such molten coating metals, when brought in contact by operating trouble or other causes, hardly adheres to the roll surface. Especially the guide roll facing the wiping nozzle remains substantially unstained by the wiped-off excess coating metal and the splash thereof. Being not reactive, vapor of the molten coating metal may adhere to the rolls, but such vapor, can be readily removed by simple gas or mechanical wiping. In addition, the smoothened surface reduces the adhesion of the coating metal vapor etc. and, when adhered, facilitates their removal. Consequently, the non-coated side of the strip contacting such clean guide rolls remains unstained by the coating metal, entailing the production of good-quality one-side-coated steel strip.

Because of the above-described feature to prevent the adhesion of such coating metals as zinc, aluminum and alloys thereof, the guide rolls are particularly suited for use in the one-side metal coating equipment. The use of these guide rolls insures that one side of the processed strip is satisfactorily coated with the coating metal of appropriately controlled weight, with the other side left prefectly clean and bare.

Even such an ideal guide roll, however, may sometimes be stained by the splash, vapor and the like of the molten coating metal. Therefore, suitable means to remove such adhesive matters must be provided.

To perform this cleaning function, a wiper is provided opposite to a guide roll so as to permit the adjustment of a space therebetween. This wiper performs cleaning by use of a gas or mechanical means.

Further, a cleaning device to keep the wiper clean is provided outside the strip pass line, which is moved, as required, toward the wiper to remove the adhesive matter therefrom. This occasional cleaning of the wiper is highly effective for keeping the non-coated surface unstained.

Figure 18:
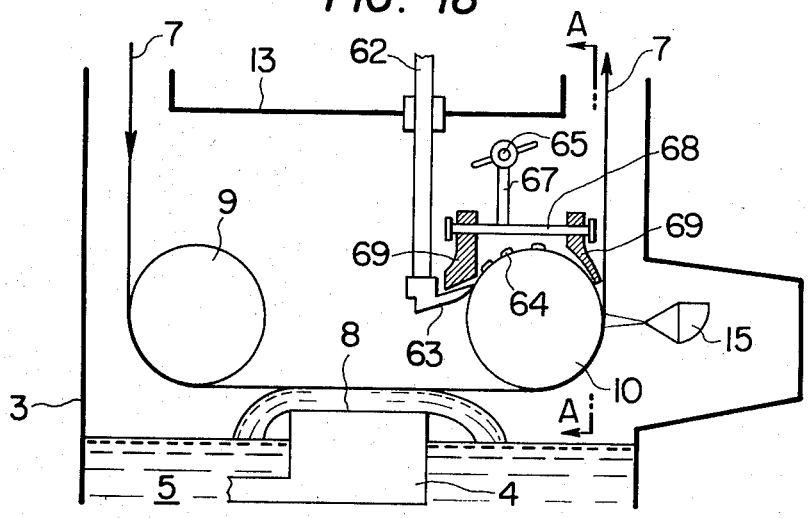
FIG. 18 shows a guide roll cleaning device in the coating apparatus.
Figure 19:
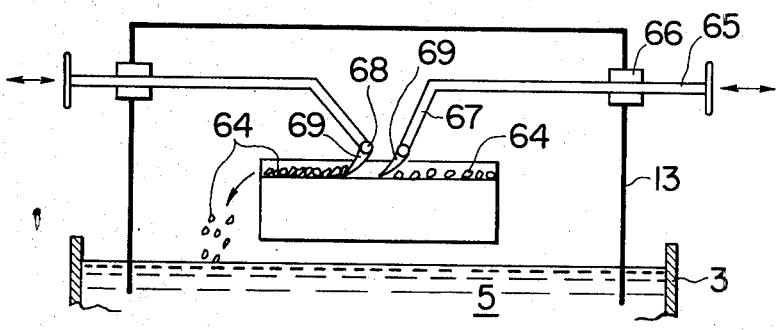
FIG. 19 is a cross-sectional view taken along the line A—A of FIG. 18.

FIGS. 18 and 19 show an example of such cleaning device. In these figures, a rod 62 is elevatably passed through the top plate of the atmosphere protection box 13. A scraper 63 is fastened to the lower end of the rod 62. The scraper 63 automatically rubs off the coating metal 64 from the surface of the rotating guide roll 10.

Through each side wall of the atmosphere protection box 13 is slidably passed an operating rod 65 held in a sealing bearing 66. A down-extending arm 67 is fastened to the foremost end of the operating rod 65. A shaft 68 is fastened to the lower end of the arm 67, just above the guide roll 10 transversely. At each end of the shaft 68 is provided a nail 69 that sweeps off the coating metal 64 which has built up on the scraper 63 and between the guide roll 10 and strip 7. The nail 69 is adapted to be fixed when moving toward the side wall along the guide roll axis, and freed to rotate about the shaft 68 when moving in the opposite direction.

When a certain quantity of coating metal 64 has collected, the operating rod 65 is manually moved back and forth to scrape off the metal 64 down to the coating metal bath 5.

Following the one-side coating and coating weight control, the strip 7 runs past a non-oxidizing atmosphere in the cooling zone 22, then out into the atmosphere. At this time, care must be taken not to solidify the molten coating metal in the non-oxidizing atmosphere. If such materials as molten zinc and Zn-Al alloy having high surface tension and fluidity (i.e., low viscosity) are solidified in a non-oxidizing atmosphere, the coated surface becomes coarse, uneven or rugged like the surface of a tortoise shall, thereby greatly destroying the commercial value of the product.

To prevent this surface roughening, the coated metal must be solidified in the presence of oxygen. The presence of oxygen is thought to lower the fluidity (or increase the viscosity) of the coated metal to an extent that permits even solidification.

Accordingly, the coated surface must be solidified in the atmosphere or in the upper portion of the cooling zone where some oxygen exists. To achieve such solidification, hot $N_2$ gas should be used for the coating weight control wiping or the coated strip surface be heated midway in the cooling zone, depending on the length and line speed of the cooling zone.

This inention uses a contrivance to keep the gas seal mechanism 20 in the cooling zone out of contact with the strip, especially the coated side thereof. After wiping, the strip 7 sometimes cambers widthwise in the cooling zone 22. Such unflat strip 7 strip strikes against the gas seal mechanism 20, whereby the strip 7 is damaged. Increasing the clearance between the strip and seal plates, an attempt to prevent such collision, results in the outflow of seal gas or inflow of outside air, impairing the sealing of the atmosphere protection box 13 and cooling zone 22.

Figure 20:
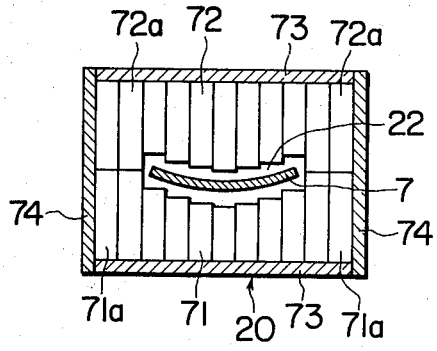
FIG. 20 is a plan view showing an embodiment of the gas seal mechanism.

FIG. 20 shows an effective gas seal mechanism 20 freed of the aforementioned difficulties. As illustrated, the gas seal mechanism 20 contains seal plates 71 and 72, comprising a plurality of horizontal slats 71*a* and 72*a*, respectively, disposed side by side. Facing each other across the strip 7 in between, the seal plates 71 and 72 are slidably attached to the front and rear walls 73 of the cooling zone 22. Depending on the curvature of the strip 7, the individual slats 71*a* and 72*a* are slid in or out, leaving an appropriate space between themselves and the strip 7. This adjustment keeps the strip 7 out of contact with the seal plates 71 and 72, while maintaining a high sealing effect. For passing a wide strip 7, those slates 71*a* and 72*a* which are closer to the side walls 74 are withdrawn to increase the width of the strip passage, and vice versa.

$N_2$ gas is supplied into the cooling zone 22 through atmosphere gas inlets 21 midway in and on the entry side of the gas seal mechanism 20. On contacting the $N_2$ gas in this cooling zone 22, the coated metal, not fully solidified yet, generates fumes containing metal dust. To prevent such fume generation, the $N_2$ gas should preferably be sprayed to the non-coated, bare side only of the one-side coated strip 7, i.e., only through the inlets 21 on the left side of FIG. 17.

Then, coming out into the atmosphere while still retaining a relatively high temperature, the strip forms a light film of oxide on the non-coated surface thereof. Commercial value of one-side coated strip will be marred unless the non-coated surface thereof is cleaned by removing such oxide film. The oxide film can be removed in a known way using a dilute solution of acid. Considering the speed and cost with which the oxide film is removed, aqueous solutions of sulfuric, hydrochloric, and phosphoric acids are preferred. The strip may be either immersed in or sprayed with such solutions. Otherwise, the strip may also be used as a cathode for electrolysis in the solution.

At the same time, care should be taken to minimize the dissolution of the coated strip surface by the acid solution. For this purpose, lower solution concentration and temperature and shorter processing time are preferred. Meanwhile, faster completion of oxide film removal calls for higher solution concentration and temperature. To satisfy these contradictory requirements, the concentration of sulfuric, hydrochloric and phosphoric acid solutions is limited between 150 and 5 g/l, and preferably between 50 and 10 g/l. The temperature of these solutions is ranges between 50° and 10° C., and preferably between 35° and 20° C.

For the quick removal of the oxide film from the non-coated surface and minimization of the coated metal dissolution, electrolytic pickling, using the strip as a cathode in a known way, is preferable.

The current density across the cathode ranges between 5 and 30 A/dm$^2$, and preferably between 10 and 20 A/dm$^2$.

Under the above-descrbed conditions, the oxide film on the non-coated strip surface is removed in 15 seconds by the immersing method, and in 3 seconds by electrolytic pickling.

A more positive way to prevent the dissolution of the coated metal is to provide in the pickling tank a roll whose surface is lined with such soft material as rubber or other similar organic substance. While the bare side of the running strip is subjected to pickling, the coated surface thereof is shieldingly pressed tight against said lined roll.

Figure 21:
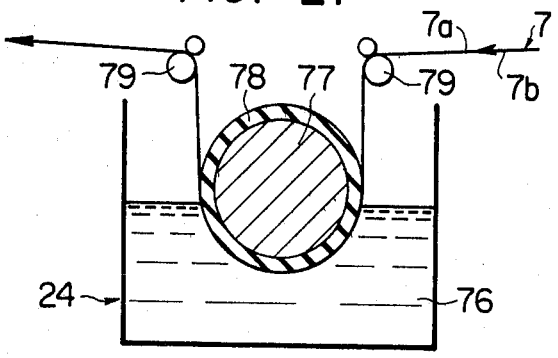
FIGS. 21 and 22 are cross-sectional views of pickling tanks. The pickling tank in FIG. 22 removes the oxide film electrolytically.
Figure 22:
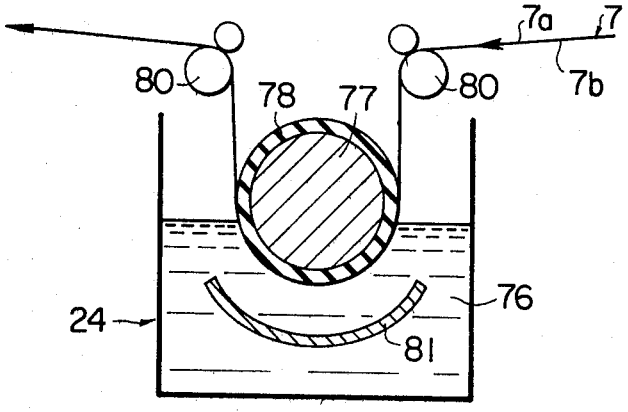

FIGS. 21 and 22 show examples of the above-described pickling tank 24 for removing the oxide film from the noncoated side of the strip. The pickling tank 24 shown in FIG. 2 is of this type. In FIGS. 21 and 22, similar parts are designated by similar reference numerals.

As seen, a coated-side shielding roll 77 is rotatably supported in the pickling tank 24, with the lower half thereof being immersed in an acid solution 76 contained therein. As mentioned before, the peripheral surface of the shielding roll 77 is surfaced with a lining 78 of rubber or other similar organic matter. Guided by a deflector roll 79 (in FIG. 21) or conductor roll 80 (in FIG. 22), the strip 7 enters the pickling tank 24. While passing through the acid solution 76, the strip 7 is wound tight half around the roll lining 78 so that the coated surface 7*a* thereof does not contact the acid solution 76. In FIG. 22, an electrode 81 is provided directly below the shielding roll 77 for electrolyticaly removing the oxide film from the non-coated strip surface 7*b*.

The shielding roll 77 must have a soft surface so as to prevent the penetration of the acid solution between the roll and coated strip surfaces. Such soft surface is obtained by lining a roll of carbon or stainless steel with hyperon, silicon or nitrile rubber or such organic matter as teflon. Instead of lining, the roll itself may be made of such soft material, but the lined steel roll is preferred because of its greater strength.

Immediately after removing the oxide film from the non-coated surface, the strip is water-washed to remove the acid solution, then dried ready for shipment.

This pickling provides a highly clean surface to the non-coated side of the strip. Subjected to annealing (box or continuous) and cooling, ordinary cold-rolled strips have such an invisible oxide film (usually comprising $Fe_3O_4$ and $Fe_2O_3$, ranging from 50 to 150 A°) as is not detrimental to their commercial value. By contrast, the pickled noncoated surface of the one-side coated strip according to this invention carries little such oxide film, except not more than approximately 30-A° of $Fe_2O_3$-based oxide electrochemically determined.

The cleanliness of this pickled non-coated strip surface is not desirable for such applications as automotive parts that involve phosphating and painting.

As is well known, the quality of painted surface depends largely on the condition of zinc phosphate formed by phosphating on the steel surface. Uniform and closely packed zinc phosphate crystals are essential to the securing of excellent-quality painted surface.

Generally, zinc phosphate is thought to be formed on the surface of steel as follows: A phosphating bath consists mainly of acid zinc phosphate ($Zn(H_2PO_4)_2$), possessing equilibrium as expressed by equation (1) below.

$$3Zn^{2+}+2H_2PO_4^{2-}\rightleftarrows Zn_3(PO_4)_2+4H^+ \quad (1)$$

When steel strip is immersed in this bath, the following dissolving reaction takes place at the surface thereof.

$$Fe+2H^+\rightarrow Fe^{2+}+H_2 \quad (2)$$

When analyzed microscopically, this dissolution consists of coupled reactions (forming microcells); production of $Fe^{2+}$ at the anode and generation of $H_2$ at the cathode. Consumption of $H^+$ ions at the cathode breaks the euilibrium of equation (1), whereupon reaction proceeds to the right, raising the pH of the solution and precipitating slightly soluble crystals of $Zn_3(PO_4)_2$ of hopeite ($Zn_3(PO_4)_2.4H_2O$). Although the crystal consists mainly of hopeite, part of $Fe^{+2}$ at the interface is replaced by Zn to produce a small quantity of phosphophyllite ($Zn_2Fe(PO_4)_2.4H_2O$). As understood from the above, zinc phosphate precipitates at the cathode portion of steel strip. Accordingly, the zinc phosphate crystal is formed over the entire surface of the strip by changing the position of cathode and anode from time to time.

Thus, precipitation of zinc phosphate is an electrochemical reaction that depends on the quality of steel surface. A surface having many microcells permits the formation of a compact zinc phosphate crystal.

The invisible oxide film on the steel surface has a great effect on the formation of microcells. More particularly, the thickness of the oxide film governs the formation and size of crystal nuclei.

The smoothened clean surface of the pickled steel devoid of an activating source for microcell formation, as is widely known, tends to form less crystal nuclei and coarser zinc phosphate crystals. The same tendency applies also to the non-coated surface of the one-side coated steel strip according to this invention. To insure not only the uniform formation of a compact zinc phosphate crystal but also the improvement of paint-adherence properties and resulting corrosion resistance, some measure must be taken, in place of the oxide film, to permit the formation of many microcells.

Studies have shown that the spraying of a suspension containing insoluble salts of divalent or trivalent metals, and preferably that of zinc phosphate, on the noncoated strip surface is effective for providing an activating source for microcell formation in place of the oxide film.

Spraying the insoluble salt suspension forms varyingly energized portions through its mechanical action and a slight amount of extra-fine reaction product on the surface of the non-coated strip surface, which both become a source to promote the formation of crystal unclei. As a consequence, a uniform, closely packed crystal of zinc phosphate is formed to improve the paint-adherence properties and corrosion resistance remarkably.

A suspension used for this spraying has a pH of 2 to 8, preferably between 3 and 7, prepared by colloidally suspensing 10 to 100 g/l, preferably between 20 and 50 g/l, of $Zn_3(PO_4)_2.5H_2O$ in an aqueous solution whose pH is adjusted by phosphoric acid. This suspension is sprayed at a pressure of 1 to 15 kg/cm$^2$, preferably between 2 and 10 kg/cm$^2$, and temperature between ordinary and 60° C., for between 1 and 30 seconds, or preferably between 2 and 10 seconds.

This suspension spray is applicable not only to the non-coated side alone but also to both sides. The same effect is obtained on the surface coated with zinc, Zn-Al alloy, etc.

If the zinc phosphate concentration is lower than 10 g/l, the desired effect is not obtained, while if the concentration exceeds 100 g/l, nozzle clogging or other operational trouble occurs.

The pH lower than 2 does not produce a suspension containing insoluble salt. Meanwhile, the pH higher than 8 does not produce the desired effect.

Spraying at a pressure lower than 1 kg/cm$^2$ fails in mechanical formation of adequate microcells. Although there is no need of setting the upper pressure limit, higher pressures than 15 kg/cm$^2$ are uneconomical, producing no significant difference in the effect.

If the spraying time is shorter than one second, reaction does not proceed enough to produce the desired effect. Producing no significant difference in the effect, spraying time longer than 30 seconds, on the other hand, is not only meaningless but also detrimental to process efficiency.

Following spraying, the one-side coated strip is water-washed to remove any residual spray liquid, then dried ready for shipment.

Though best accomplished in line with the one-side coating unit, as shown in FIGS. 1 and 2, the above-described pickling and zinc phosphate suspension spraying may be conducted off line.

Figure 23:
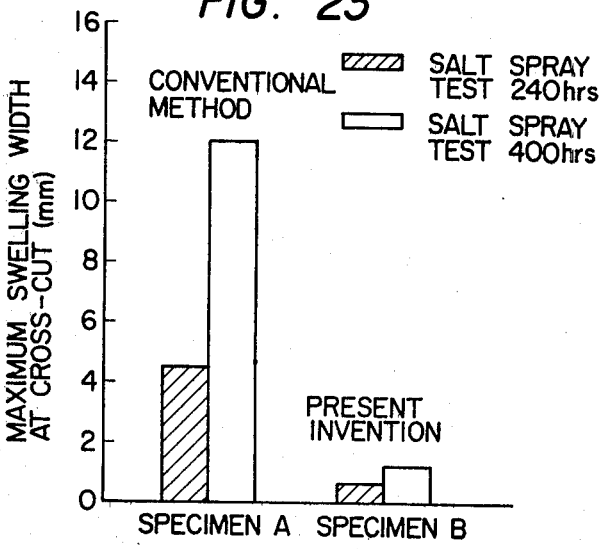
FIG. 23 graphically compares corrosion resistance of the non-coated surfaces obtained by the conventional method and the method of this invention.

FIG. 23 compares the phosphatabilities of a steel strip according to this invention, the non-coated surface of which has been sprayed with a zinc phosphate suspension, and a conventional steel strip whose non-coated surface remains as-pickled. More particularly, FIG. 23 shows a difference in corrosion resistance between the two strips prepared by the method of this invention and a conventional one, in terms of the maximum swelling width at a cross cut resulting from salt spray tests. Evidently, the strip of this invention is approximately 5 times more corrosion-resistant (or 1/5 as corrosive) than the conventional strip.

Now some other embodiments of this invention will be described by reference to FIGS. 24 through 27, wherein such parts as are similar to those already described are designated by similar reference numerals, and no further description is given thereto.

Figure 24:
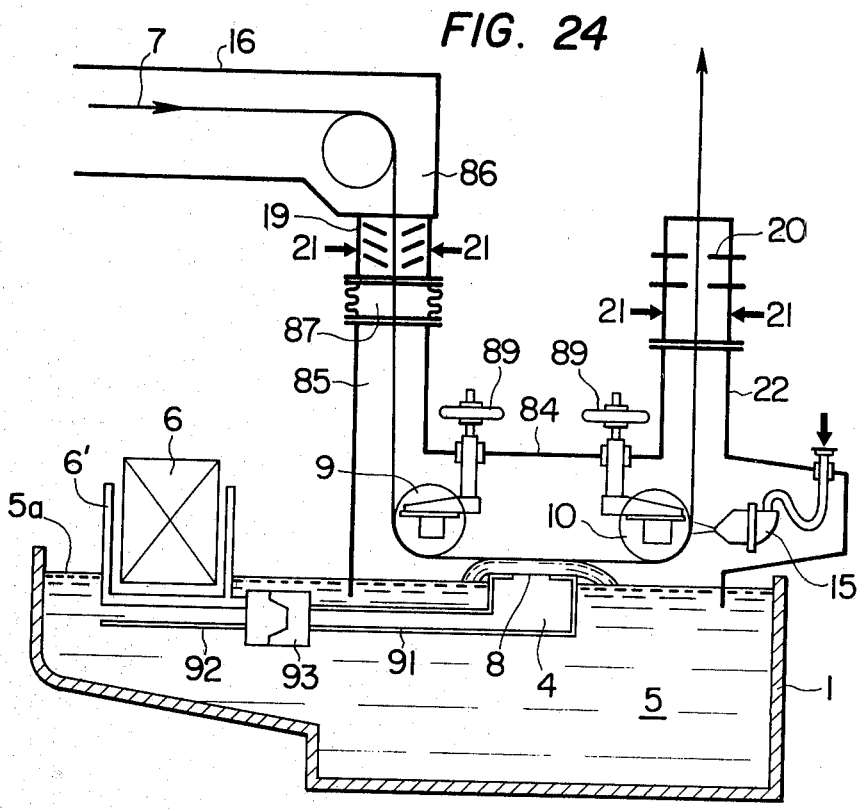
FIG. 24 is a schematic view showing yet another embodiment of this invention.

In a one-side coating apparatus of FIG. 24, an atmosphere protection box 84 is elevatably suspended, with the inlet 85 thereof connected thorugh a bellows 87 to the outlet 86 of the reducing-annealing unit 16. Guide rolls 9 and 10 each are attached to the lower end of a set of adjusting shafts 89 elevatably extending into the atmosphere protection box 84. Each set comprises two adjusting shafts 89 disposed in the direction of the width of a strip 7 (i.e., perpendicular to the paper). Accordingly, the guide rolls 9 and 10 can be inclined in the axial direction thereof by moving up or down the adjusting shafts 89. This permits coating the strip 7 in the right position, bringing the center thereof into alignment with the pass line. In addition, the adjusting shaft 89 are also capable of keeping the strip 7 horizontal between the guide rolls 9 and 10, or at a desired level above the bath surface 5*a*.

A molten metal guide 4 is divided into a front section 91 and a rear section 92 coupled together by a joint 93. An electromagnetic pump 6 is placed near the rear section 92, while the front section 91 sends forth a rising stream 8 of a molten coating metal 5. This bisected guide 4 permits interchanging the front section 91 with one that has a coating metal overflow port of an appropriate size for the width of the strip being processed. Such a guide is easier to inspect and maintain, too. The electromagnetic pump 6 and guide 4 are elevatable. The front section 91 of the guide 4 is supported independent of the rear section 92, joint 93, and electromagnetic pump 6.

Figure 25:
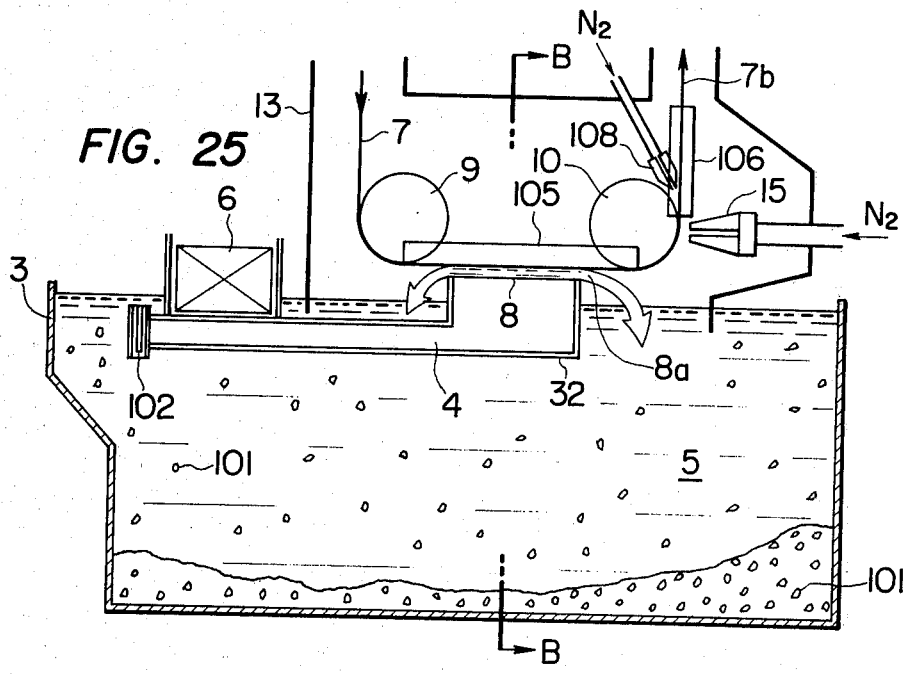
FIG. 25 is a schematic view showing still another embodiment of this invention.
Figure 26:
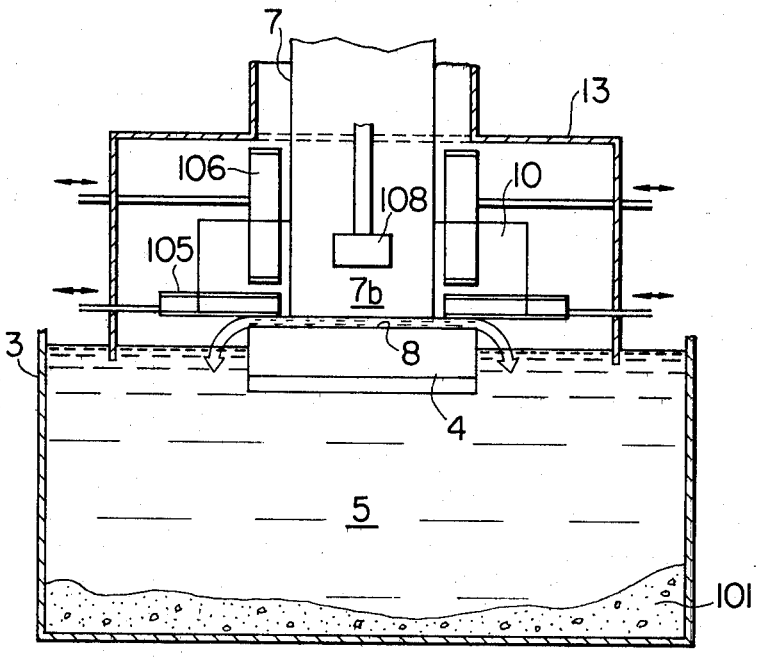
FIG. 26 is a cross-section view taken along the line B—B of FIG. 27.

FIGS. 25 and 26 show still another embodiment of this invention. FIG. 26 is a cross-sectional view taken along the line B—B of FIG. 25.

Excess coating metal 8*a* overflowing from the overflow box 32 forces up dross 101 from the pot bottom, which then enters the guide 4, carried over by the coating metal 5. Left unremoved by the jet gas from the gas wiping nozzle 15, dross 101 on the strip 7 solidifies there to impair the quality of the strip 7. A dross filter 102 is provided at the entry end of the guide 4 to block the entry of dross 101. The dross filter 102 comprises laminated sheets of such materials as glass fiber and $TiO_2$-$Al_2O_3$ that can withstand the chemical and heat attack of the molten coating metal. The mesh size of the filter is progressively reduced from upstream to downstream of the coating metal flow.

The settling dross clogs the filter and increases the flow resistance, thus decreasing the flow of the coating metal and the height of the rising metal stream. To overcome this problem, the filter may be provided in a readily replaceable cassette form. Or the filter clog may be removed by driving the electromagnetic pump 6 so as to reverse the coating metal flow, immersing the whole guide in the coating metal bath. The use of the dross filter 102 assures the production of good-quality one-side coated steel strip, free of detrimental dross.

In a sealed structure containing a non-oxidizing atmosphere fumes arise from the surface of the metal bath. Fume generation increases especially when $N_2$ gas impinges on where the rising metal stream 8 contacts the strip 7 and, after completing wiping, on the coated strip surface.

In FIGS. 25 and 26, paired fume catchers 105 and 106 are disposed near the strip. A pair of fume catchers 105 are provided horizontally along the edges of the strip 7 between the guide rolls 9 and 10. Another pair of fume catchers 106 are provided vertically, also along the strip edges, on the exit side of the guide roll 10. The fume catchers 105 and 106 each have an opening that faces the edge of the strip 7, directed, as much as possible, perpendicular to the stream of the $N_2$ gas. The fume catchers 105 and 106 are slidable according to the varying width of the strip 7. The $N_2$ gas containing fumes and dust is drawn off through the openings to outside the atmosphere protection box 13. After dust removal through a common bag-type, cyclone or other filter, the cleaned gas is returned to the atmosphere protection box 13.

Reducing dust build-up and fume spreading inside the atmosphere protection box 13, which might stain the strip 7, these fume catchers contribute to the securing of good strip surface quality, and save equipment maintenance and working environment contamination.

Especially dust entrapped in a small space between the guide roll 10 and the leaving strip 7 tends to stay there for a long time, continually stainning the strip surface. To prevent such entrapping, a dust-removing nozzle 108 is directed toward the small space formed by the guide roll 10 and the non-coated strip surface 7*b* on the exit side thereof, as shown in FIGS. 25 and 26. The dust-removing nozzle 108 removes the collected dust off the strip edges by blowing $N_2$ gas toward the center of the strip 7. Consequently, dust adhesion on the non-coated strip surface decreases and surface quality improves.

Figure 27:
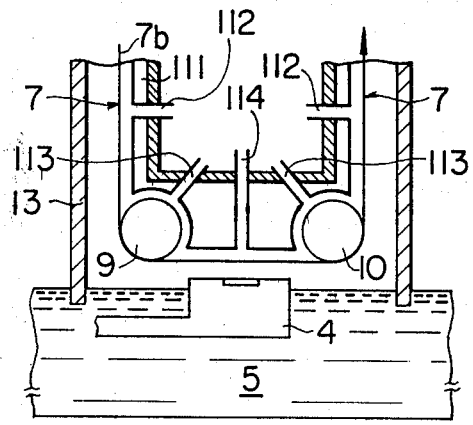
FIG. 27 is a schematic cross-sectional view of an atmosphere protection box with a cover extending over the strip.

FIGS. 27 shows another means for preventing the adhesion of fume dust to the non-coated strip surface. As seen, a cover 111 is provided in the atmosphere protection box 13 so as to cover the non-coated side 7*b* of the strip 7 and that periperal portion of the guide rolls 9 and 10 which is out of contact with the strip 7. The cover 111 is provided with $N_2$ gas injection ports 112, 113 and 114 facing the non-coated surface 7*b* of the vertically running strip 7, peripheral surface of the guide rolls 9 and 10, and noncoated surface 7*b* of the horizontally running strip 7, respectively. The $N_2$ gas injected through the ports 112, 113 and 114 prevents fumes from flowing over to the noncoated side 7*b* of the strip, flowing across the width of the strip 7 into the atmosphere protection box 13.

The following paragraphs described how the coating operation is started. If the guide 4 or overflow box 32 in FIGS. 15 and 16, for example, are left above the bath surface 5*a*, dross collects, and metal crystals precipitate therefrom, inside the guide 4. When the electromagnetic pump 6 is operated, the collected dross prevents uniform flow of the coating metal 5 which is essential to the formation of a uniformly coated surface. Further, the dross collected in the guide 4 is difficult to remove.

Berore starting coating operation, therefore, the whole guide 4 is immersed in the molten coating metal bath 5 and the electromagnetic pump 6 is operated at low rate to wash the dross and other foreign matters out of the guide 4. The coating metal may be reversed in the guide 4. A hydraulic cylinder or other drive means (not shown) mounted on the support 52 is used for bringing the guide 4 and electromagnetic pump 6 in and out of the coating metal bath. The level of the guide 4 is accurately adjusted to maintain an appropriate clearance between the overflow port and the strip surface, using a level guage etc. (not shown).

EXAMPLE 1

| | |
|---|---|
| Material strip | As-cold-rolled steel strip, 0.8 mm thick and 914 mm wide |
| Coating metal | Zn-0.15% Al at 450° C. |
| Non-oxidizing gas in protection box and cooling zone | $N_2$ gas ($O_2$ concentration in coating zone = 50 ppm) |
| Line speed | 50 m/min. |
| Clearance between overflow port top and strip | 10 mm (Clearance between bath surface and strip = 30 mm) |
| Coating metal-strip contact | 0.18 second |
| Strip temperature | 480° C. |
| Coating equipment | Shown in FIG. 1 |
| Guide | (1) Shown in FIG. 6. Overflow port 150 mm long by 750 mm wide, with 12 mm deep cut (2) With skirt (FIG. 11, inclined at 20 degrees with respect to bath surface) and cover (FIG. 12) |
| Deflector roll | Sprayed with 200 $\mu$ $Cr_2O_3$, then polished to 0.5 $\mu$Ra surface roughness |

The strip, held under a tension of 1.5 kg/mm$^2$, was passed substantially horizontally at a height of 30 mm above the bath surface. With a frequency of 1.5 Hz, the electromagnetic pump sent up the molten coating metal from the inlet of the guide, at a depth of 200 mm below the bath surface or 800 mm above the pot bottom, so as to contact the bottom surface only of the strip. Since the overflow port shown in FIG. 6 offered less resistance widthwise to facilitate the widthwise flow, the coating metal spread evenly across the strip width, without flowing over to the opposite side in absence of the anti-overflow gas injection. The metal coating weight was controlled to 110 g/m$^2$ by applying $N_2$ gas wiping at a temperature of 30° C. and a pressure of 0.1 kg/cm$^2$. The wiping nozzle was positioned 30 mm away from the strip, directed to where the vertically turned strip still remained in contact with the guide roll. Before the coated layer had solidifed, the strip retaining a temperature of 420° C. was taken out into the atmosphere for cooling. Then, the oxide film was removed by electrolytically pickling in a 3% aqueous solution of hydrochloric acid at ordinary temperature, applying a current density of 10 A/dm$^2$ and using the strip as a cathode.

In the surface adjustment unit, a suspension containing a colloid of $Zn_3(PO_4)_2 \cdot 5H_2O$ (25 g/l) and having a pH adjusted to 7 was sprayed on to the non-coated surface of the strip at a pressure of 3 kg/cm$^2$ for 3 seconds.

The product strip thus obtained was smoothly and evenly coated on one side only, with the opposite side remaining clean, not stained by the overflow of the coating metal.

Properties, especially adhesiveness, of the coating layer proved excellent. The non-coated side of the strip too exhibited excellent phosphatability and after-painting corrosion resistance.

EXAMPLE 2

| | |
|---|---|
| Material strip | As-cold-rolled steel strip, 0.6 mm thick and 1000 mm wide |
| Coating metal | Zn-0.20% Al at 480° C. |
| Non-oxidizing gas | $N_2$ gas ($O_2$ concentration in coating zone = 10 ppm) |
| Line speed | 75 m/min. |
| Clearance between bath surface and strip | 45 mm |
| Wiping nozzle pressure | 0.25 kg/cm$^2$ |
| Strip temperature | 525° C. |
| Coating equipment | Shown in FIG. 2 |
| Guide | (1) Shown in FIG. 7. Overflow port 950 mm wide by 300 mm long maximum and 100 mm long minimum, with 7 mm deep cut (2) With skirt (FIG. 11, inclined at 30 degrees with respect to bath surface) and cover (FIG. 12) |
| Clearance between overflow port top and strip | 25 mm (Clearance between bath surface and strip = 55 mm) |
| Coating metalstrip contact time | 0.24 second maximum (strip center) and 0.08 second minimum (strip edges) |

The strip, held under a tension of 2.5 kg/mm$^2$, was passed substantially horizontally at a height of 55 mm above the bath surface. With a frequency of 3.8 Hz, the electromagnetic pump sent up the molten coating metal from a depth of 500 mm below the bath surface or 1000 mm above the pot bottom, so as to contact the bottom surface only of the strip. Since the overflow port shown in FIG. 7 offence less resistance widthwise to facilitate the widthwise flow, the coating metal spread evenly across the strip width, without flowing over to the opposite side.

The metal coating weight was controlled to 60 g/m$^2$ by applying $N_2$ gas wiping at a temperature of 350° C. ($N_2$ gas being heated by the waste heat of the reducing unit) and a pressure of 0.25 kg/cm$^2$. The wiping nozzle was positioned 10 mm away from the strip, directed to where the vertically turned strip still remained in contact with the guide roll.

The strip retaining a temperature of 460° C. was taken out into the atmosphere for coating solidification and cooling. Then, the oxide film was removed by immersing the strip in a 10% solution of $H_2SO_4$ at 50° C., held in the pickling tank shown in FIG. 21, for 7 seconds, without damaging the coating surface.

In the surface adjustment unit, a suspension containing a colloid of $Zn_3(PO_4)_2.5H_2O$ (30 g/l) and having a pH adjusted to 4 was sprayed on to both surfaces of the strip at a pressure of 2 kg/cm$^2$ for 5 seconds.

The product strip thus obtained was smoothly and evenly coated on one side only, with the opposite side remaining clean, not stained by the overflow of the coating metal.

Properties, especially adhesiveness, of the coating layer proved excellent. The non-coated side of the strip too exhibited excellent phosphatability and after-painting corrosion resistance.

What is claimed is:

1. In a method of continuously coating one side only of a steel strip with a molten coating metal including the steps of:

(1) passing the steel strip to be coated substantially horizontally above a bath of the molten coating metal, with guide rolls imposing longitudinal tension thereon, through a chamber containing a molten metal coating bath, the chamber being filled with a nonoxidizing atmosphere, (2) forcing the molten coating metal via an electromagnetic pump up from a submerged inlet of an adjacent molten metal guide to an outlet opening positioned above the molten coating metal bath surface forming a rising stream of the coating metal on the exit side of the outlet, and (3) contacting the rising metal stream with the bottom surface of the substantially flat steel strip to be coated, the improvement comprising positively flowing the molten coating metal toward both edges of the substantially horizontal flat strip by passing the molten metal through the metal guide outlet offering less flow resistance to the rising molten metal stream on the exit side of the guide outlet along the width thereof and offering greater flow resistance to the rising molten metal along the length thereof with respect to the running strip, thus positively forcing the flow of molten metal out to both edges of the substantially horizontal, flat strip; and thereby forming a uniform layer of the coating metal on the bottom side of the strip thus contacted with the metal while preventing the coating metal from flowing over to the opposite non-coated side of the steel strip.

2. A continuous one-side strip coating method according to claim 1, in which the frequency of the electromagnetic pump is between 1 and 20 Hz.

3. A continuous one-side strip coated method according to claim 1, in which the weight of the coating metal is controlled by injecting a high-pressure gas through a gas wiping nozzle onto the coated side of the substantially vertically travelling strip in the vicinity of the guide roll that deflects the running direction of the strip from horizontal to substantially vertical.

4. A continuous one-side strip coating method according to claim 3, in which the high-pressure gas is injected on to the coated side where the strip remains in contact with the guide roll.

5. A continuous one-side strip coating method according to claim 3, in which the injection gas is heated in a piping passed through a reducing-annealing furnace preceding the coating unit, then injected on to the coated strip surface through a gas wiping nozzle at high temperature and pressure.

6. A continuous one-side strip coating method according to claim 3, in which the injection gas is heated in a piping passed through the coating metal bath, then injected on to the coated strip surface through a gas wiping nozzle at high temperature and pressure.

7. A continuous one-side strip coating method according to claim 1, in which a chamber-sealing gas is injected on to the non-coated surface of the strip in a chamber-seal section of a cooling zone on the exit side of said chamber holding the non-oxidizing atmosphere, thereby preventing the generation of metal dust due to $N_2$ gas injection.

8. A continuous one-side strip coating method according to claim 1, in which the coated strip leaving-said chamber is subjected to pickling for removing an oxide film from the non-coated side thereof.

9. A continuous one-side strip coating method according to claim 8, in which the pickling is performed while winding the coated side of the strip tightly substantially half around a deflector roll partly immersed in a pickling solution so that the coated side is kept out of contact therewith.

10. A continuous one-side strip coating method according to claim 8, in which a suspension containing an insoluble phosphate of a divalent or triablent metal is sprayed on to at least the pickled non-coated surface of the strip.

11. A method of continuously coating one side only of a steel strip with a molten coating metal comprising the steps of:

passing the steel strip to be coated substantially horizontally above a bath of the molten coating metal, with guide rolls imposing longitudinal tension thereon, through a closed chamber containing molten metal bath, the chamber being filled with a nonoxidizing atmosphere, forcing the molten coating metal via an electromagnetic pump up from the molten metal bath and through a molten metal guide having an outlet positioned above the molten coating metal bath surface the forced molten metal forming a rising stream on the exit side of the outlet, and contacting the rising metal stream with the bottom surface of the steel strip to be coated and positively flowing the molten coating metal toward both edges of the substantially horizontal flat strip by passing the molten metal through a guide outlet offering less flow resistance to the rising molten metal stream on the exit side of the guide outlet along the width thereof and offering greater flow resistance to the rising molten metal along the length thereof with respect to the running strip thereby positively forcing the flow of molten metal to contact the steel strip, spread evenly along the bottom surface thereof and flow downwardly returning to the molten metal bath without staining the opposite surface of said strip, forming a uniform layer of the coating metal on the bottom side of the strip thus contacted with the metal while preventing the coating metal from flowing over to the opposite side of the steel strip.

* * * * *